US005087856A

United States Patent [19]

Yoshizawa et al.

[11] Patent Number: 5,087,856

[45] Date of Patent: Feb. 11, 1992

[54] DISCHARGE ELECTRODE HAVING A THIN WIRE CORE AND SURFACE COATING OF AMORPHOUS ALLOY FOR A DISCHARGER

[75] Inventors: Michio Yoshizawa, Yokohama; Tsunebumi Matsunaga, Ichihara; Makoto Ebata, Tokyo; Yasuo Oyama, Ichihara, all of Japan

[73] Assignees: Ricoh Company, Ltd.; Mitsui Engineering & Shipbuilding Co., Ltd., both of Tokyo, Japan

[21] Appl. No.: 540,123

[22] Filed: Jun. 19, 1990

[30] Foreign Application Priority Data

Jun. 19, 1989 [JP] Japan ..... 1-156551
May 29, 1990 [JP] Japan ..... 2-138835

[51] Int. Cl.[5] ..... H01J 1/14; H01J 1/38; H01J 1/48; H01T 19/00

[52] U.S. Cl. ..... 313/631; 313/633; 313/355; 250/324; 361/230

[58] Field of Search ..... 313/631, 632, 633, 355, 313/623; 250/324; 361/230

[56] References Cited

U.S. PATENT DOCUMENTS

| | | | |
|---|---|---|---|
| 3,813,549 | 5/1974 | Di Stefano et al. | 313/355 |
| 4,092,560 | 5/1978 | Puská | 313/623 |
| 4,574,219 | 3/1986 | Davenport et al. | 313/355 |
| 37604,970 | 9/1971 | Culbertson et al. | 313/355 |

FOREIGN PATENT DOCUMENTS 61-132966 6/1986 Japan .

*Primary Examiner*—Donald J. Yusko
*Assistant Examiner*—John Giust
*Attorney, Agent, or Firm*—Oblon, Spivak, McClelland, Maier & Neustadt

[57] ABSTRACT

A discharge electrode for a charger has a thin wire or core made of stainless steel or electrolytically polished tungsten, and a coating provided on the thin line. To form the coating, amorphous alloy containing tantalum, niobium, zirconium, titanium or similar element belonging to the same group on the periodic table is deposited on the thin wire by sputtering, CVD (Chemical Vapor Deposition) or similar technology. The content of tantalum in the amorphous alloy is selected to be 10 at % to 70 at %.

11 Claims, 2 Drawing Sheets

DISCHARGE ELECTRODE HAVING A THIN WIRE CORE AND SURFACE COATING OF AMORPHOUS ALLOY FOR A DISCHARGER

BACKGROUND OF THE INVENTION

The present invention relates to a discharge electrode for use in a charger which is incorporated in an electrophotographic image forming apparatus, electric dust collector, sewage treating apparatus or similar apparatus and, more particularly, to a thin wire included in such a charger to serve as a discharge electrode.

Generally, an electrophotographic image forming apparatus such as an electrophotographic copier has a photoconductive element having a photoconductive layer on the surface thereof. The photoconductive element is uniformly charged to a predetermined polarity by a charger having a discharge electrode. The discharge electrode has customarily been implemented as a thin wire of tungsten, stainless steel or similar wire and oxidized or plated with gold. The oxidation forms an oxide layer for preventing an oxide film from being formed on the surface of the thin wire in the event of discharge. This kind of discharge electrode effects a corona discharge when applied with a voltage of 4 kV to 7 kV.

It is likely with the thin wire of the above-stated discharge electrode that its surface suffers from regeneration and deterioration due to aging and, in due course, fails to achieve a uniform charging or discharging characteristic in the axial direction of the electrode. Such an occurrence is ascribable mainly to the fact that the uniform surface condition of the thin wire is disturbed by the corrosion of the surface of the wire due to repeated discharge and by the crack or separation of the oxide layer or that of the plated layer. Another major cause is the deposition of oxides and ionization products on the thin wire due to the ionization of air components, moisture, ozone and various impurities such as dust particles exiting between discharge electrodes which is brought about by discharge energy in the event of discharge.

In the light of the above, a discharge electrode having a thin wire made of amorphous alloy has been proposed. Specifically, an aluminum trioxide ($Al_2O_3$) film may be formed on the surface of a thin film of Fe—Si—B amorphous alloy to a thickness of 5000 Å by sputtering, as disclosed in Japanese Patent Laid-Open Publication (Kokai) No. 132966/1986. Another approach is to form the entire thin wire by use of amorphous alloy, as also proposed in the art.

A discharge electrode entirely made of amorphous alloy as mentioned above little suffers from regeneration and deterioration on the surface thereof, but providing such a discharge electrode with an outside diameter as small as several ten microns in the amorphous state and in uniform dimensions in both of the sectional and longitudinal directions would be extremely difficult, if not possible, and would need a disproportionate production cost.

Assume that the amorphous alloy for coating the surface of the thin wire contains 12 at % (atomic percent) of tungsten (W) and is deposited on the thin wire to a thickness of 0.5 μm. A drawback with this kind of discharge electrode is that as it is repeatedly used, a white product whose major component is siliocon dioxide ($SiO_2$) sometimes deposits on the electrode surface in a needle-like configuration. Such a white product is apt to effect the uniform discharge current distribution in the axial direction of the thin wire. Presumably, the deposition of the white product is caused by silicon oil which is used in a fixing device of an electrophotogaphic copier for the separation of a toner and is evaporated by heat to produce silicon. This phenomenon is especially conspicuous when use is made of a thin wire containing tungsten (W). Since the above-mentioned deposit is insulative as apparent from the component, the discharge current noticeably fluctuates in the axial direction of the thin wire and, hence, it is impossible to set up a uniform charging or discharging condition over the entire discharging range.

SUMMARY OF THE INVENTION

It is therefore an object of the present invention to provide a discharge electrode for a charger which achieves uniform charging and discharging characteristics at a relatively low cost.

It is another object of the present invention to provide a generally improved discharge electrode for a charger.

A discharge electrode for effecting corona discharge of the present invention comprises a thin wire constituting a core of the discharge electrode, and a layer formed on the surface of the thin wire by coating the surface with amorphous alloy which contains a predetermined metal element.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
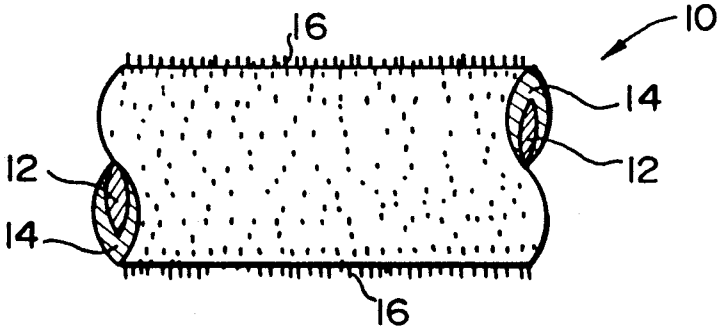
FIG. 1 PRIOR ART
FIG. 1 is a fragmentary enlarged view of a prior art discharge electrode.
Figure 2:
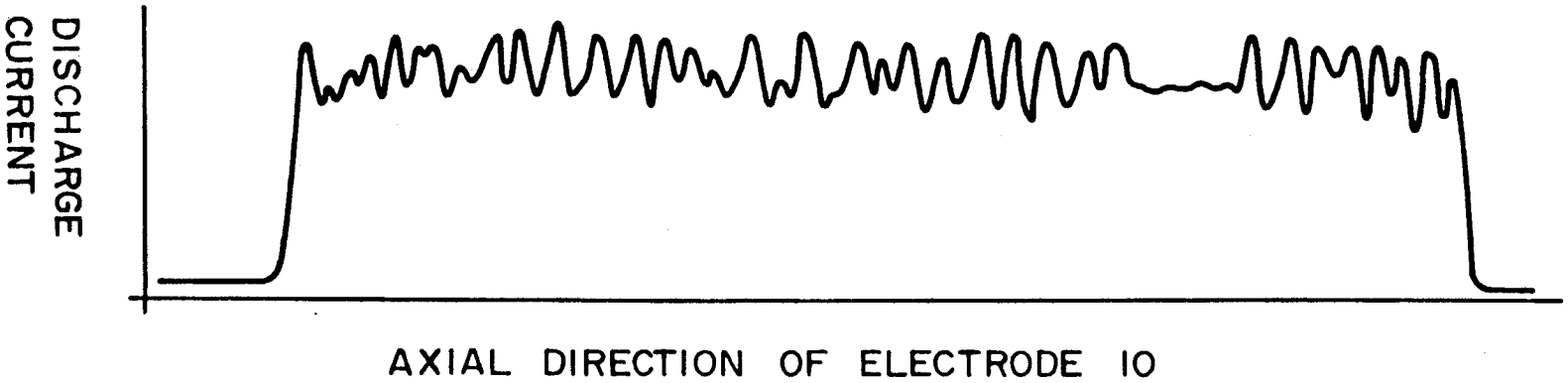
FIG. 2 PRIOR ART
FIG. 2 plots a characteristic particular to the electrode shown in FIG. 1.

To better understand the present invention, a brief reference will be made to a prior art discharge electrode, shown in FIG. 1. As shown, the prior art electrode, generally 10, has a thin wire 12 and a layer 14 of tungsten-containing amorphous alloy. As the electrode 10 is used over a long period of time, a white product 16 whose major component is silicon dioxide ($SiO_2$) is apt to deposit on the surface of the electrode 10 in a needle-like configuration and thereby to disturb the uniform discharge current distribution in the direction in which the electrode 10 is stretched, i.e. in the axial direction. Specifically, as shown in FIG. 2, the product 16 which is insulative causes the discharge current to noticeably fluctuate in the axial direction of the electrode 10 as represented by the abscissa, so that a uniform discharging condition is not attainable over the entire discharging range. The specific discharge current distribution shown in FIG. 2 was observed when corona discharge was continued for 100 hours. This is the problem with the prior art discharge electrode 10 which has the tungsten-containing amorphous alloy layer 14.

Figure 4:
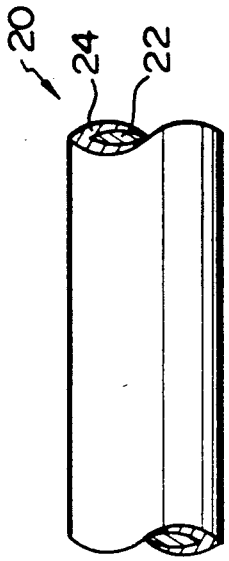
FIG. 4 is a fragmentary enlarged view of the illustrative embodiment.
Figure 3:
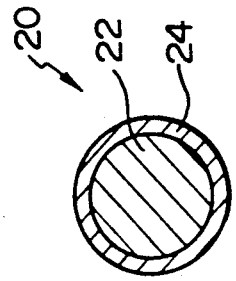
FIG. 3 is a section of a discharge electrode embodying the present invention.
Figure 5:
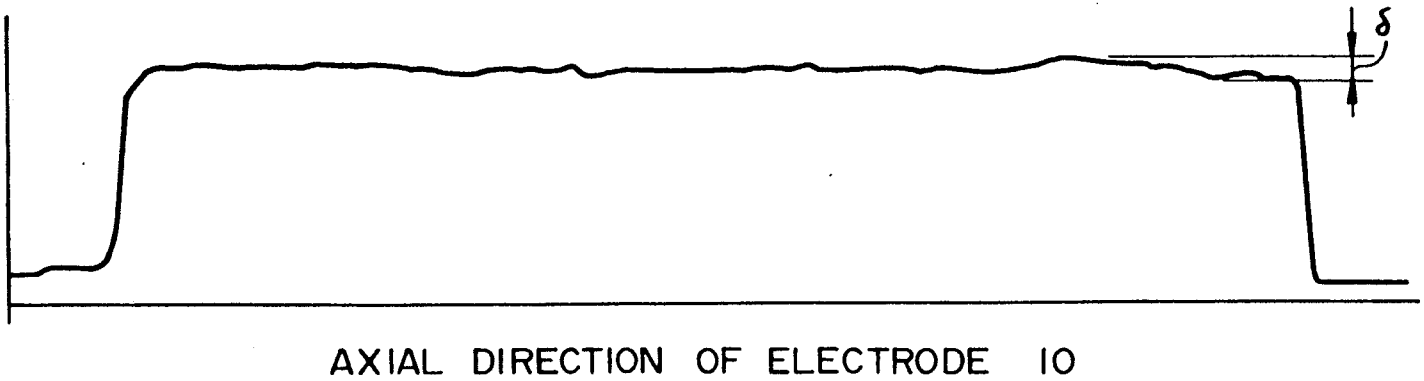
FIG. 5 plots a characteristic attainable with the illustrative embodiment.

Referring to FIGS. 3 to 5, a discharge electrode for a charger embodying the present invention will be described. FIG. 3 shows in a section a discharge electrode 20 of the present invention which has a core in the form of a thin wire 22. A characteristic feature of the electrode 20 is a coating 24 of tantalum-containing amorphous alloy. The coating 24 is formed on the surface of the thin wire 22 by the sputtering of such alloy to a thickness of 0.05 μm to 10 μm. The core or wire 22 is made of electrolytically polished tungsten or stainless steel. In the amorphous electrode constituting the coating 24, the content of tantalum is selected to be 10 at %. Sputtering such an amorphous alloy to the thickness of 0.05 μm to 10 μm on the surface of the wire 22 is successful in improving the fixing strength thereof with the wire 22, i.e., the bonding strength, compared to a thin layer produced by plating. If desired, sputtering may be replaced with CVD (Chemical Vapor Deposition).

An electrophotographic copier, for example, is often used in an ozonic atmosphere and, moreover, in an environment wherein air components, moisture, ozone and various impurities such as dust particles are ionized by discharge energy to corrode the surface of the thin wire and to oxidize and deposit on the wire. A series of experiments showed that selecting the content of the major component of amorphous alloy as mentioned above is optimal in insuring mechanical strength and corrosion resistance. It was also experimentally proved that the use of tantalum as a major component reduces the deposition of $SiO_2$ which is ascribable to the evaporation of silicon oil adapted to separate a toner as stated earlier.

The discharge characteristics of the thin wire 22 of the illustrative embodiment were determined by experiments, as follows.

A first experiment was conducted by use of a thin wire 22 made of electrolytically polished tungsten and having a diameter of 60 μm. An amorphous alloy containing 42 at % of tantalum as a major component thereof (Ta—Fe—Ni—Cr) was deposited on the wire 22 by sputtering in an evacuated atmosphere of $2\times10^{-4}$ Torr, while causing argon (Ar) gas to flow at a rate of 5 ml/min and applying an output of several hundred watts. This operation was continued until a 1 μm thick amorphous layer 24 was formed on the wire 22. The wire 22 with the amorphous layer 24 was used as a positive corona discharge electrode of an electrophotographic copier and subjected to a continuous discharge. The result of the first experiment was favorable concerning the initial characteristics, particularly the fluctuation in the current which sets up a predetermined discharged charge per unit area. Even after 100 hours of negative corona discharge, no noticeable changes were observed on the surface of the amorphous alloy coating 24, as shown in FIG. 4. Further, oxides and ionization products were little deposited on the coating 24. FIG. 6 shows the fluctuation of current as measured in the axial direction of the discharge electrode 20, the abscissa being representative of the axial direction. After continuous 100 hours of discharge, the fluctuation of the illustrative embodiment was measured to be less than one-third of the fluctuation of the prior art electrode 10 of FIG. 1, as indicated by a symbol δ in FIG. 5. With the illustrative embodiment, image quality higher than the prior art was attained even when a grid electrode for negative corona discharge was not used. By comparing FIG. 5 with FIG. 2, it will be seen that the illustrative embodiment constitutes a noticeable improvement over the prior art. It is to be noted that the comparison was made with respect to a standard fluctuation of current because the fluctuation is sometimes greatly dependent on the environment, atmosphere, and so forth. Of course, the contents and spluttering conditions of the amorphous metal described above are not limitative so long as the metal is based on tantalum. For example, any desired content of tantalum may be selected within the range of 10 at % to 70 at %.

A second experiment, like the first experiment, used a thin wire 22 of electrolytically polished tungsten. Amorphous alloy containing 20 at % of tantalum was sputtered onto the surface of the wire 22 to form a coating 24. The wire with the coating 24 was subjected to repetitive positive corona discharge for electrophotography. Such an electrode exhibited extremely desirable initial characteristics and, even after 80 hours of corona discharge, allowed hardly any oxides and ionization products to deposit thereon. Again, the fluctuation of current in the axial direction of the electrode 20 was measured to be less than one-third of the fluctuation of the prior art electrode 10, FIG. 1, even after 80 hours of positive corona discharge. While positive corona discharge is generally considered far more uniform than negative corona discharge, the result of the second experiment is even superior to that which would be achieved in such compratively desirable condition.

While the illustrative embodiment uses tantalum as the major component of amorphous alloy, tantalum may be replaced with any other suitable element so long as it belongs to the same group as tantalum on the periodic table, e.g. niobium (Nb), zirconium (Zr) or titanium (Ti).

In summary, in accordance with the present invention, a thin wire or core of a discharge electrode is coated with tantalum-containing amorphous alloy by spluttering. Despite such a relatively simple structure, the electrode achieves higher mechanical strength and corrosion resistance than the prior art and, therefore, frees the surface of the wire from deterioration and regeneration while eliminating the deposition of products. By selecting the content of tantalum within the range of 10 at % to 70 at %, it is possible to prevent products such as silicon dioxide from depositing on the surface of the coating. It follows that the surface condition of the electrode and, therefore, the current distribution is maintained uniform along the axis of the electrode. The electrode is, therefore, relatively inexpensive and, yet, uniform in charging and discharging characteristics.

Various modifications will become possible for those skilled in the art after receiving the teachings of the present disclosure without departing from the scope thereof.

What is claimed is:

1. A discharge electrode for effecting a corona discharge, consisting essentially of:

a thin wire constituting a core of said discharge electrode; and a layer formed on a surface of said thin wire by coating said surface with an amorphous alloy which contains a predetermined metal element, wherein the predetermined metal element is at least one member selected from the group consisting of tantalum, niobium, zirconium, and titanium.

2. A discharge electrode as claimed in claim 1, wherein said layer is formed by spluttering the amorphous alloy.

3. A discharge electrode as claimed in claim 1, wherein said layer is formed by chemical vapor deposition of the amorphous alloy.

4. A discharge electrode as claimed in claim 1, wherein tantalum contained in the amorphous alloy has a content of 10 at % to 70 at %.

5. A discharge electrode as claimed in claim 1, wherein said thin wire is made of electrolytically polished tungsten.

6. A discharge electrode as claimed in claim 1, wherein said thin wire is made of stainless steel.

7. A discharge electrode as claimed in claim 1, wherein said metal element is tantalum.

8. A discharge electrode as claimed in claim 1, wherein said metal element is niobium.

9. A discharge electrode as claimed in claim 1, wherein said metal element is zirconium.

10. A discharge electrode as claimed in claim 1, wherein said metal element is titanium.

11. A discharge electrode as claimed in claim 1, wherein said layer has a thickness of 0.05 to 10 μm.

* * * * *